United States Patent [19]

Nishibori et al.

[11] Patent Number: 4,518,159

[45] Date of Patent: May 21, 1985

[54] SHEET PAPER ATTRACTING SYSTEM

[75] Inventors: Toshiki Nishibori; Sumio Kita, both of Nara; Sakuharu Takano, Yamatokoriyama, all of Japan

[73] Assignee: Sharp Kabushiki Kaisha, Osaka, Japan

[21] Appl. No.: 468,958

[22] Filed: Feb. 23, 1983

[30] Foreign Application Priority Data

Mar. 1, 1982 [JP] Japan ..... 57-32633

[51] Int. Cl.[3] ..... B65H 3/08

[52] U.S. Cl. ..... 271/103; 271/106; 271/107

[58] Field of Search ..... 271/11, 20, 100, 101, 271/103, 104, 106, 107

[56] References Cited

U.S. PATENT DOCUMENTS 1,249,042 12/1917 Dexter ..... 271/107 X 4,380,331 4/1983 Fischer ..... 271/103 X

FOREIGN PATENT DOCUMENTS 2710448 9/1978 Fed. Rep. of Germany ..... 271/103

*Primary Examiner*—Richard A. Schacher

*Attorney, Agent, or Firm*—Birch, Stewart, Kolasch & Birch

[57] ABSTRACT

A paper sheet attracting system includes a suction air casing, a paper sheet attracting unit which has a bottom wall provided with a plurality of air intake openings, and a pressure roller for depressing the paper sheets to be supplied. The leading edge of a paper sheet attracted by the paper sheet attracting unit is caught by a paper sheet feeding member for transferring the paper sheet. When the paper sheet feeding member is enabled, the pressure roller is driven to shift upward so that the pressure roller is separated from the paper sheets. Furthermore, when the paper sheet feeding member is enabled, the suction operation conducted by the paper sheet attracting unit is interrupted, whereby the paper sheet is transferred without disturbance.

3 Claims, 8 Drawing Figures

SHEET PAPER ATTRACTING SYSTEM

BACKGROUND AND SUMMARY OF THE INVENTION

The present invention relates to a sheet paper attracting system for use in a sheet paper feeding system of a copying machine, a facsimile system, a printing machine, etc.

Various types of sheet paper feeding systems have been developed for supplying a paper sheet from a storing section where a plurality of sheets are stacked. One type of the sheet paper feeding system employs a sheet feed roller for catching a paper sheet through the use of the friction caused by the rotating sheet feed roller. This type of sheet paper feeding system may damage the surface of the paper sheet. Furthermore, an accurate feeding operation is not ensured when the sheet paper has a low friction factor, or when the surface construction of the sheet feed roller is deteriorated due to long time usage.

Another type of the sheet paper feeding system employs an air pump for attracting a paper sheet. More specifically, a sheet paper attracting unit is connected to a suction air casing which includes a vacuum chamber therein. The sheet paper attracting unit faces the uppermost paper sheet stored in the storing section. In the conventional system, the sheet paper attracting unit is tightly fixed to the suction air casing and, therefore, an accurate attracting operation is not ensured when the paper sheet has an uneven surface, or when the relationship between the locations of the sheet paper attracting unit and the sheet paper storing section is not exactly adjusted.

Accordingly, an object of the present invention is to provide a sheet paper attracting system which ensures an accurate paper sheet feeding operation.

Another object of the present invention is to provide a mechanism which allows an adjusting movement of a sheet paper attracting unit with respect to a suction air casing.

Still another object of the present invention is to provide a sheet paper attracting system which prevents the piled feeding of paper sheets even when the thickness of the paper sheet varies.

A further object of the present invention is to provide a control system which ensures a smooth feeding in a paper sheet attracting system.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, the sheet paper attracting unit is connected to the suction air casing via a flexible duct so that the sheet paper attracting unit is movable with respect to the suction air casing.

In a preferred form, an attracting suction force control circuit is provided for varying the suction force in accordance with the thickness of a paper sheet. Furthermore, the sheet paper attracting unit is constructed to rotate by a predetermined angle while the center of a paper sheet is depressed by a depression roller in order to prevent the piled feeding of paper sheets. The leading edge of a paper sheet attracted by the sheet paper attracting unit is caught by a sheet feeding member. When the sheet feeding member is enabled to feed the paper sheet, the suction operation is terminated and the depression roller is pulled upward in order not to disturb the sheet feeding operation.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

An embodiment of a sheet paper attracting system of the present invention includes a sheet paper attracting unit, a suction air casing, a flexible duct for connecting the sheet paper attracting unit to the suction air casing, and a pressure roller for applying a predetermined pressure to the paper sheet.

Figure 3:
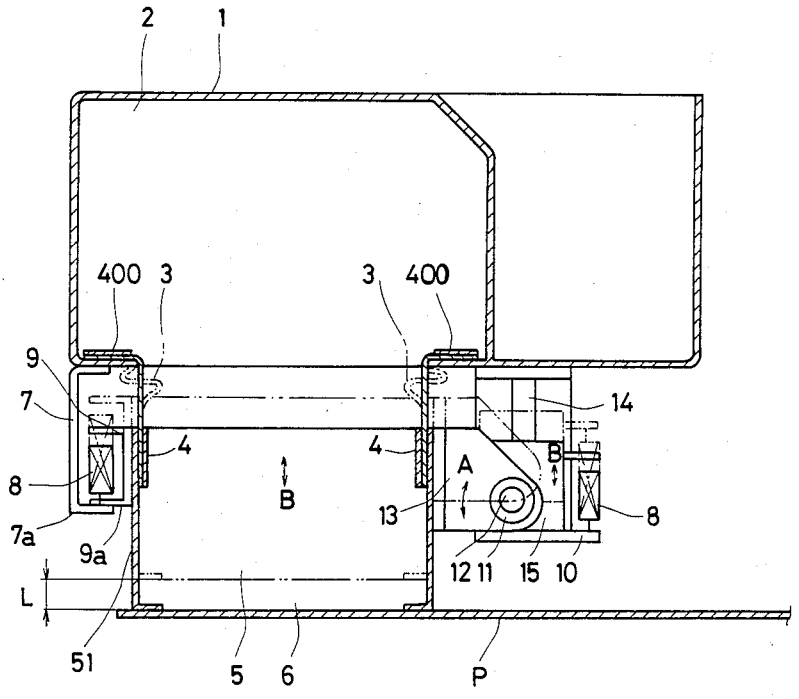
FIG. 3 is a schematic sectional view of the sheet paper attracting system taken along line III—III of FIG. 1.

A suction air casing 1 includes a vacuum air chamber 2 formed therein (see FIG. 3). A sheet paper attracting unit 5 has a plurality of intake openings 6 formed in the bottom surface thereof in order to attract the paper sheet. The sheet paper attracting unit 5 is connected to the suction air casing 1 via a flexible duct 3 made of a flexible member such as a rubberized cloth.

One end of the flexible duct 3 is fixed to a side wall 51 of the sheet paper attracting unit 5 by a fixing member 4. The other end of the flexible duct 3 is fixed to a bottom wall of the suction air casing 1 by another fixing member 400.

The sheet paper attracting unit 5 is normally pulled downwardly by a tension member 8 such as a spring. The lowest position of the sheet paper attracting unit 5 is determined by a tension angle 9 (*9a*) which supports the tension member 8, and a stopper angle 7 (*7a*) which is secured to the suction air casing 1 to confront the tension angle 9. The lowest position of the sheet paper attracting unit 5 is further determined by a slider 15 which is movably supported by a shaft for rotatably supporting the sheet paper attracting unit 5, and a slider stopper 10 disposed under the slider 15.

Moreover, the sheet paper attracting unit 5 is connected to an angle 13 which is rotatably (in the direction shown by an arrow A) supported by a shaft 12 via bearings 11. The shaft 12 movably supports the slider 15 which is movable in the direction shown by an arrow B along a slider shaft 14 which is secured to the slider stopper 10. Accordingly, the sheet paper attracting unit 5 is vertically movable by a length L due to the sliding operation of the slider 15 along the slider shaft 14 even though the sheet paper attracting unit 5 is normally pulled downward by the tension member 8. It will be clear that the vertical movement of the sheet paper attracting unit 5 is permitted by the provision of the flexible duct 3 which connects the sheet paper attracting unit 5 to the suction air casing 1. Furthermore, the sheet paper attracting unit 5 is rotatable around the shaft 12 by an angle corresponding to the length L.

Figure 4:
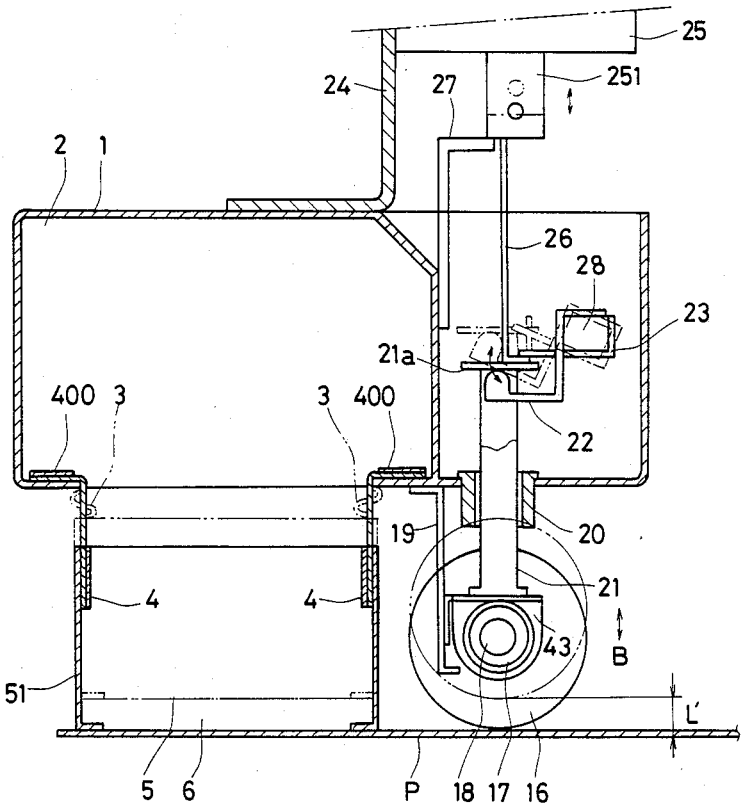
FIG. 4 is a schematic sectional view of the sheet paper attracting system taken along line IV—IV of FIG. 1.

The sheet paper attracting system of the present invention further includes, as shown in FIG. 4, a pressure roller 16 rotatably secured to a shaft 18 via bearings 17. The shaft 18 is supported by an angle 43 which is secured to a slider 21 which is disposed through a bearing member 20 formed in the suction air casing 1. At the upper end of the slider 21, a contacting plate 21*a* is provided. The contacting plate 21*a* is engaged with one end of an arm 22 which is rotatably supported by a shaft 28. Another angle 23 is rotatably supported by the shaft 28.

One end of the angle 23 is engaged with a latch 26 which is connected to a solenoid 25. In response to the ON/OFF operation of the solenoid 25, the slider 21 is vertically moved by a length L′ via the latch 26. That is, the pressure roller 16 is vertically shifted by the length L′ by the solenoid 25.

Figure 7:
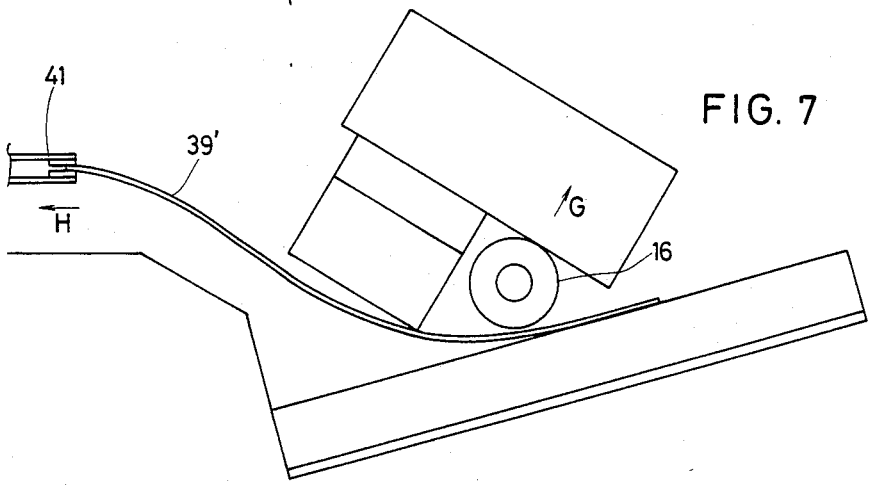

In the normal condition, the solenoid 25 is deenergized so that the pressure roller 16 is held at the lowest position (shown by the solid line in FIG. 4) by means of the tension means such as the spring, whereby the depression roller 16 depresses a paper sheet P. At this moment, an operating rod 251 of the solenoid 25 contacts a stopper 27 to limit the lowest position of the pressure roller 16. The pressure roller 16 is movable when it is depressed upward. Furthermore, when the sheet feeding operation is conducted by a sheet feeding member 41 as shown in FIG. 7, the solenoid 25 is energized to separate the pressure roller 16 from the paper sheet P.

Figure 1:
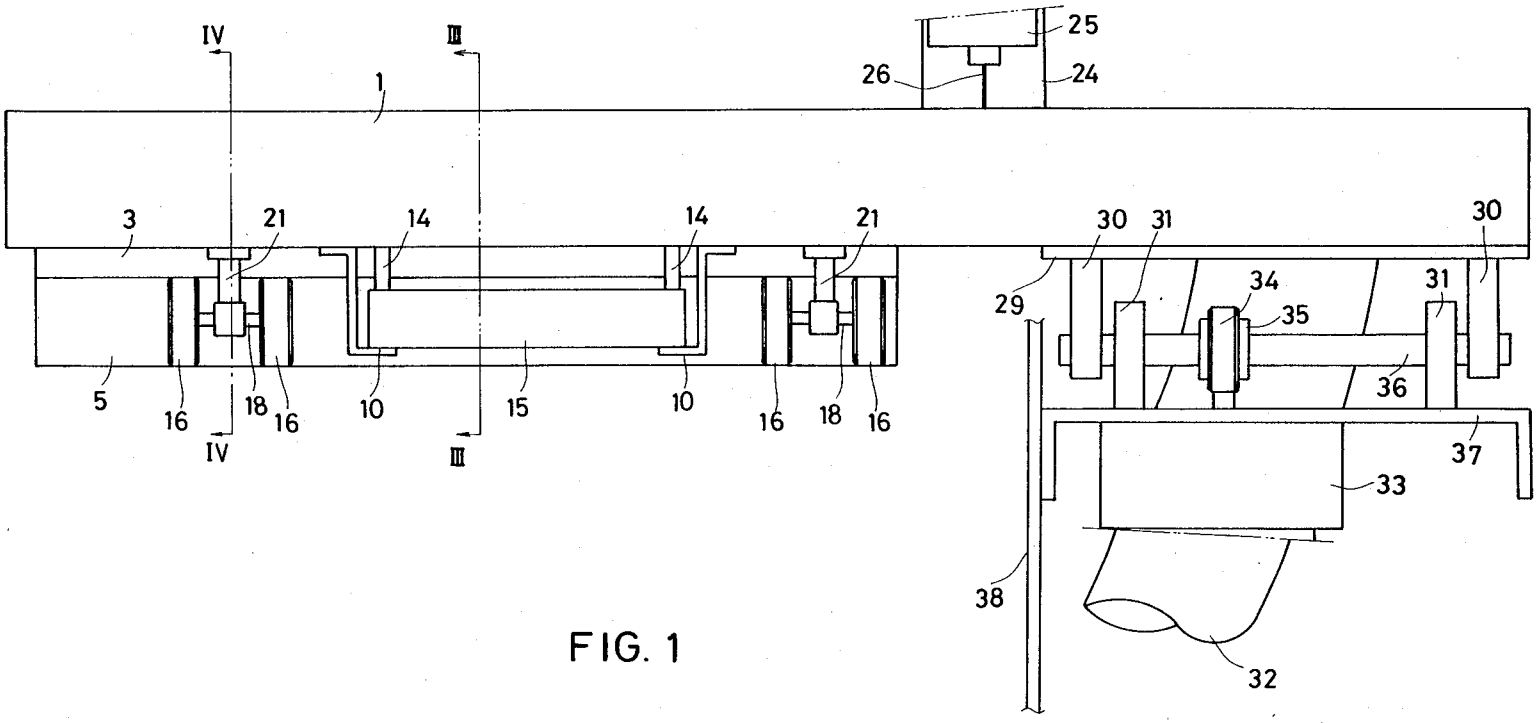
FIG. 1 is a front view of an embodiment of a sheet paper attracting system of the present invention.
Figure 2:
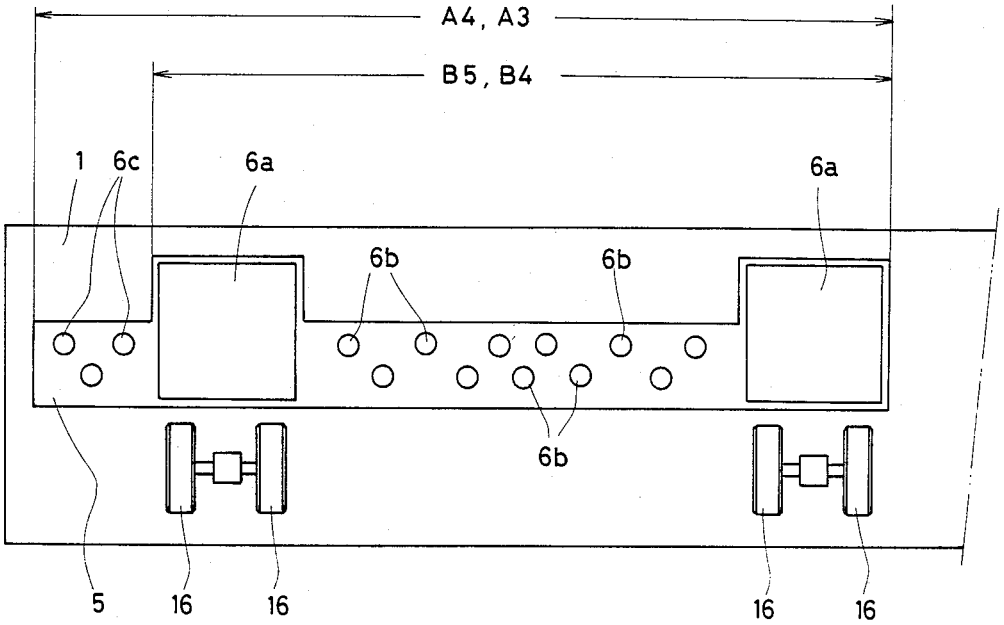
FIG. 2 is a bottom view of an essential part of the sheet paper attracting system of FIG. 1.

FIG. 1 is a front view of the sheet paper attracting system of the present invention. A motor 33 is secured to a motor supporting angle 37 in order to rotate the entire system of the present invention. A table plate 29 is attached to the suction air casing 1. A supporting member 30, which is integral with a driving shaft 36, is secured to the table plate 29. The driving shaft 36 is provided through a bearing section of a supporting member 31 which is secured to the motor supporting angle 37. The rotation of the motor 33 is transferred to the driving shaft 36 via a worm 34 connected to the rotating shaft of the motor 33 and a worm wheel 35 fixed to the driving shaft 36. The suction air casing 1 is connected to a suction blower (not shown) via a duct 32. The intake openings 6 formed in the bottom surface of the sheet paper attracting unit 5 include two large intake openings 6*a* and a plurality of small intake openings 6*b* and 6*c* as shown in FIG. 2. The small intake openings 6*c* are provided for attracting the paper sheets of the size A4 and A3. The small intake openings 6*c* are preferably closed by a shutter when the paper sheets of the size B5 and B4 are desired to be transferred.

The attracting suction force created through the openings 6 is controlled by a suction force control circuit 86. When a sheet attracting detection circuit 84 develops a signal indicating the condition wherein the paper sheet is not attracted, the suction force control circuit 86 functions to increase the attracting suction force. The attracting suction force is controllable by varying the rotation speed of the suction blower, or by controlling a throttle plate disposed in the duct 32.

The rotation speed of the motor 33 is controlled by a speed control circuit 80. The rotation of the entire system is conducted in a manner that the contacting point of the pressure roller 16 and the paper sheet P functions as the supporting point. When the signal is developed from the sheet attracting detection circuit 84 indicating the condition wherein the paper sheet is not attracted, the speed control circuit 80 functions to reverse the motor rotation for repeating the paper sheet attracting operation.

An operational mode of the sheet paper attracting system of the present invention will be described with reference to FIGS. 5, 6 and 7.

Paper sheets 39 are stacked on a sheet supporting table 40. A sheet paper feeding mechanism includes a guide plate 42 and the sheet feeding member 41. In the sheet paper attracting system of the present invention, a mode setting is first conducted for varying the attracting force in response to the thickness of the paper sheet which should be fed. That is, a mode selection circuit develops a control signal to select the attracting suction force, which is applied to the suction force control circuit 86.

Figure 5:
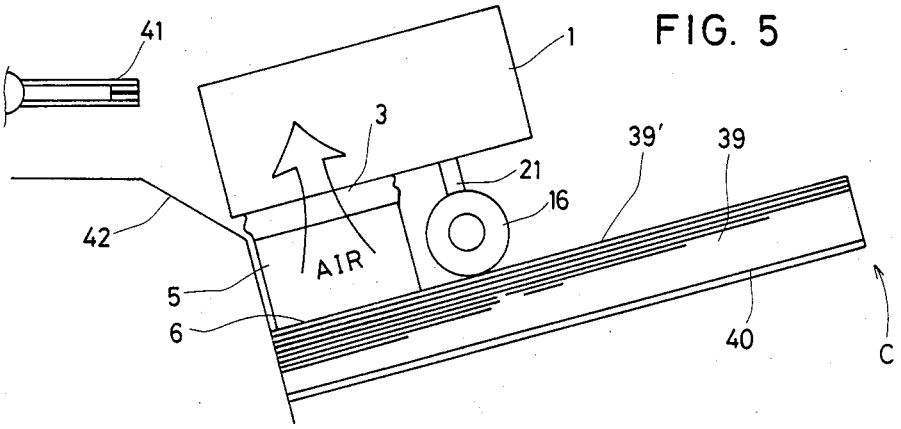
FIGS. 5, 6 and 7 are schematic side views of the sheet paper attracting system for explaining an operational mode of the sheet paper attracting system of FIG. 1.

When the paper sheet feed initiation is instructed, the sheet supporting table 40 is slided upward along an arrow C so that the uppermost paper sheet 39′ slightly pushes upward the bottom surface of the sheet paper attracting unit 5 and the pressure roller 16 as shown in FIG. 5.

Under these conditions, the air suction operation is conducted to introduce air through the openings 6 formed in the bottom surface of the sheet paper attracting unit 5. Even when the location of the sheet supporting table 40 deviates from a predetermined position, the deviation is compensated for by the flexible duct 3. More specifically, as shown in FIG. 3, the sheet paper attracting unit 5 is movable in the vertical direction by the length L with respect to the suction air casing 1 by the provision of the flexible duct 3. Therefore, the uppermost paper sheet 39′ is securely attached to the bottom surface of the sheet paper attracting unit 5 if the deviation of the location of the sheet supporting table 40 is within the length L. At this moment, the paper sheets 39 are pressed downward by the pressure roller 16.

Figure 6:
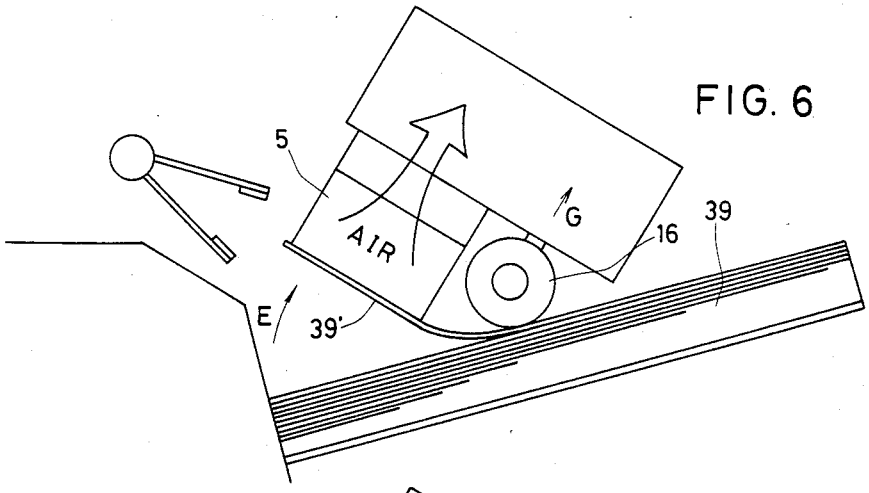
Figure 8:
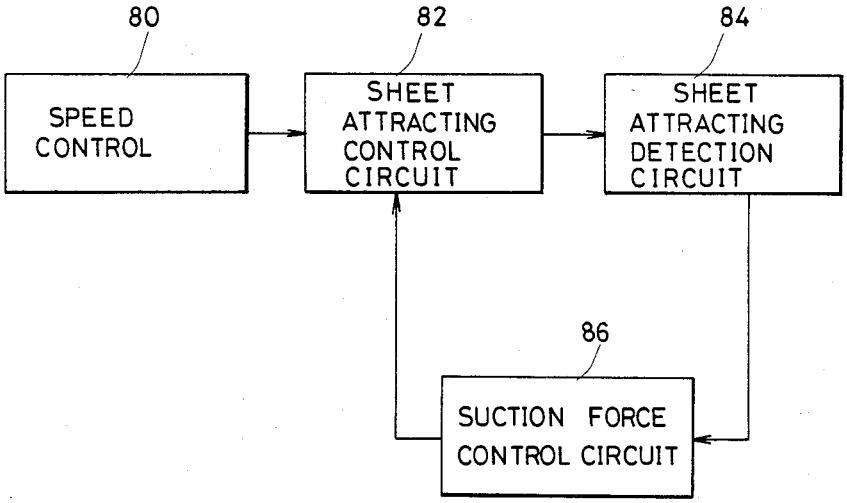
FIG. 8 is a schematic block diagram of a control system for activating the sheet paper attracting system of FIG. 1.

Then, the sheet paper attracting system of the present invention is rotated in the direction shown by an arrow E in FIG. 6. The rotating operation is conducted while the air suction operation is maintained in a manner that the contacting point of the pressure roller 16 and the uppermost paper sheet 39′ operates as the supporting point. The rotating operation is driven by the motor 33 and controlled by the speed control circuit 80 (see FIG. 8) so that rotating speed is gradually increased and the rotation is terminated when the rotation angle reaches a preselected value. By gradually increasing the rotation speed of the sheet paper attracting system, the uppermost paper sheet 39′ is separated from the next paper sheet due to the air introduction into the gap formed between the uppermot paper sheet 39′ and the next paper sheet. Furthermore, the uppermost paper sheet 39′ is securely attracted to the air intake openings 6.

If the uppermost paper sheet 39' is not properly attracted by the sheet paper attracting unit 5, the sheet attracting detection circuit 84 (see FIG. 8) detects an abnormal condition by detecting the variation of the load current of the suction blower. In response to the abnormal detection output derived from the sheet attracting detection circuit 84, the operation shown in FIGS. 5 and 6 is repeated to properly attract the uppermost paper sheet 39'. When the paper sheet attracting operation is not properly conducted even though the above-mentioned operation is repeated several times, the suction force is increased by the suction force control circuit 86. If the paper sheet attracting operation is not carried out at all, an alarm circuit (not shown) should be enabled, and the system operation should be interrupted.

In a condition shown in FIG. 6, the pressure roller 16 is slightly shifted in the direction shown by an arrow G. The pressure roller 16 depresses the paper sheets 39 at a predetermined pressure. Accordingly, if a plurality of paper sheets are erroneously attracted at the same time, the depression force of the pressure roller 16 functions to increase the strength of the paper sheets, whereby the uppermost paper sheet 39' is separated from the next succeeding paper sheets. Furthermore, the paper sheets next to the uppermost paper sheet 39' are held at a predetermined position by the pressure roller 16.

Since the small openings **6*b* are formed at a center portion of the sheet paper attracting unit 5 as shown in FIG. 2, a center portion of the paper sheet is accurately attracted by the sheet paper attracting unit 5** without creating crimps.

When the uppermost paper sheet 39' is attracted by the sheet paper attracting unit 5 as shown in FIG. 6, the sheet feeding member 41 catches the leading edge of the uppermost paper sheet 39' to feed the paper sheet in the direction shown by an arrow H in FIG. 7. When the sheet feeding operation is initiated by the sheet feeding member 41, the air suction operation is interrupted through the use of the suction force control circuit 86, and the solenoid 25 is activated to pull up the pressure roller 16 via a latch 26 so that the pressure roller 16 does not contact the uppermost paper sheet 39'.

The above-mentioned operations of FIGS. 5, 6 and 7 are successively repeated. The height of the uppermost paper sheet 39' is gradually lowered while the paper sheet feeding operation is repeated. The flexible duct 3 allows the shift movement of the sheet paper attracting unit 5 so that the sheet paper attracting unit 5 contacts the uppermost paper sheet 39' at a predetermined pressure.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A paper sheet supplying system comprising:

a paper sheet holder for supporting paper sheets stacked thereon;

a paper sheet attracting unit having a first major wall provided with a plurality of air intake openings, said first major wall confronting said paper sheets supported by said paper sheet holder;

suction means for creating an attracting suction force through said air intake openings;

a pressure roller for depressing said paper sheets supported by said paper sheet holder by a predetermined pressure;

a paper sheet feeding member for transferring a paper sheet attracted by said paper sheet attracting unit; and drive means for separating said pressure roller from said paper sheets when said paper sheet feeding member transfers a paper sheet.

2. The paper sheet supplying system of claim 1, wherein said suction means comprises:

a suction air casing having a vacuum chamber formed therein;

a flexible duct for movably connecting said paper sheet attracting unit to said suction air casing; and control means for interrupting the operation of said suction means when said paper sheet feeding member transfers a paper sheet.

3. The paper sheet supplying system of claim 1, wherein said drive means comprises:

a solenoid; and connecting means for connecting said solenoid to said pressure roller.

* * * * *